US007040834B2

(12) United States Patent
Nardi

(10) Patent No.: US 7,040,834 B2
(45) Date of Patent: May 9, 2006

(54) DEVICE FOR LOCKING A FLEXIBLE LAMINAR ELEMENT TO A FRAME

(75) Inventor: Giampietro Nardi, Chiampo (IT)

(73) Assignee: Nardi SPA, Chiampo (IT)

( * ) Notice: Subject to any disclaimer, the term of this patent is extended or adjusted under 35 U.S.C. 154(b) by 104 days.

(21) Appl. No.: 10/487,766

(22) PCT Filed: Jul. 2, 2003

(86) PCT No.: PCT/EP03/07043

§ 371 (c)(1),
(2), (4) Date: Feb. 26, 2004

(87) PCT Pub. No.: WO2004/004518

PCT Pub. Date: Jan. 15, 2004

(65) Prior Publication Data

US 2004/0245842 A1 Dec. 9, 2004

(30) Foreign Application Priority Data

Jul. 5, 2002 (IT) ..... VI2002A0148

(51) Int. Cl.
*F16B 21/00* (2006.01)

(52) U.S. Cl. ..... 403/329; 403/355; 403/375; 297/440.11; 297/452.59; 297/452.13

(58) Field of Classification Search ..... 403/326, 403/329, 355, 375; 297/440.11, 452.59, 297/452.13

See application file for complete search history.

(56) References Cited

U.S. PATENT DOCUMENTS

| | | | | |
|---|---|---|---|---|
| 4,552,406 | A | 11/1985 | Ohl | |
| 5,195,222 | A | 3/1993 | Rink | |
| 5,503,454 | A | 4/1996 | Sakamoto | |
| 5,662,383 | A * | 9/1997 | Hand | 297/440.11 |
| 6,254,190 | B1 * | 7/2001 | Gregory | 297/452.1 |
| 6,378,944 | B1 | 4/2002 | Weisser | |
| 6,540,950 | B1 * | 4/2003 | Coffield | 264/257 |

FOREIGN PATENT DOCUMENTS

| | | |
|---|---|---|
| DE | 101 20 621 | 11/2002 |

* cited by examiner

*Primary Examiner*—Daniel P. Stodola
*Assistant Examiner*—Michael P. Ferguson
(74) *Attorney, Agent, or Firm*—Dykema Gossett PLLC

(57) ABSTRACT

A locking device of a flexible laminar element connected to a frame, in order to achieve a bearing structure which houses a person's body, comprises a groove obtained along one part of the perimeter of the frame and a shaped insert which is pressed into the groove in order to constrain the perimetral edge of the flexible laminar element between the groove and the shaped insert. Inside the grove a plurality of openings is arranged for the passage of as many appendixes of the shaped insert equipped with coupling elements which snap the shaped insert to the frame.

13 Claims, 4 Drawing Sheets

DEVICE FOR LOCKING A FLEXIBLE LAMINAR ELEMENT TO A FRAME

BACKGROUND OF INVENTION

The invention is about a locking device for connecting a flexible laminar element to a frame, specifically suitable for being used in the making of structures apt to hold a person's body such as chairs, deck-chairs, sun-beds, and alike.

In the state of the art sun-beds, deck-chairs or chairs, the surfaces where the person's body lays on are sometimes made of flexible laminar elements like synthetic fabrics, drilled foils of the Kerma straw kind or alike.

These flexible laminar elements are fixed to the frame of the bearing structure through appropriate locking devices.

Some state of the art locking devices are made of screws which are applied to the frame's perimeter in order to fix the flexible laminar element to the same frame.

Other state of the art locking devices provide for the use of synthetic strings which pass first through eyelets found on the edges of the flexible laminar element and that are subsequently turned into protrusions present along the frame's perimeter.

A first inconvenience of the state of the art locking devices available on the market consists in that the assembly of the flexible laminar element to the frame is particularly difficult.

A second inconvenience, related to the first one, consists in that the above-mentioned problem considerably affects both on the production times and costs.

A further inconvenience consists in that the assembly must be carried out by expert personnel who flawlessly achieves the operation.

The locking devices with synthetic strings, in addition, have the inconvenience that the interlace of the strings which carries out the connection between the flexible laminar element and the frame is not very hygienic, because the strings are a vehicle for the depositing of dirt.

Furthermore it is possible that the strings, because they are freely accessible, can be subject to tampering or breaking thus jeopardizing the safety of the people who utilize these handworks.

The last but not least inconvenience is that the presence of such strings provide the sun-bed with a no less than questionable look.

SUMMARY OF THE INVENTION

It is the object of the present invention to remedy the above-mentioned inconveniences.

More specifically, it is a first object of the invention that of making a locking device that, with the reliability and seal being equal to the state of the art locking device, would allow to noticeably reduce the assembly time of the bearing structure compared to what occurs in the state of the art technique.

It is another object that of making a locking device that for its manual assembly would not require the operator to have any particular ability.

It is a further object that of making a locking device which could be also applied automatically to the frame.

It is yet another object that of making a locking device which would improve the look of the bearing structure as a whole.

It is a further object that of making a locking device which would provide the greatest connection safety between the frame and the flexible laminar element.

It is still another object that of making a locking device that would get rid of potential gaps wherein impurities of all kinds could get deposited.

It is a last but not least object that the invented device can be easily removed from the frame in order to allow the check up, replacement or cleaning of some components of the bearing structure.

Said objects are achieved by a locking device of a flexible laminar element connected to a frame in order to achieve a bearing structure for a person's body that, in line with the main claim, is characterized in comprising a groove obtained along at least one part of the perimeter of said frame and a shaped insert suitable for being pressed into said groove in order to constrain the perimetral edge of said flexible laminar element between said groove and said shaped insert; inside said grove a plurality of openings is arranged for the passage of as many appendixes of said shaped insert equipped with coupling means fit to snap said shaped insert to said frame.

Advantageously, the application of the flexible laminar element to the frame turns out to be particularly easy and fit to be carried out with the aid of automatic machines as well.

The invention likewise allows having a safe anchorage of the flexible foil to the frame, thus improving the safety of the user who lays him/herself on the structure.

Yet advantageously, the device of the invention allows achieving a continuity between the flexible laminar element and the frame, thus considerably reducing the gaps wherein the impurities can get deposited and in the meanwhile by providing the entire structure with a particularly attractive line.

Equally useful, the locking device is made in such a manner that the part which is exposed to the sun rays is made of polyamide that under these circumstances is notoriously not subject to deterioration, while the part exposed to sunlight is made of polyvinyl chloride (PVC).

This allows the connection of the flexible laminar element to the locking device through welding.

BRIEF DESCRIPTION OF THE DRAWINGS

Said objects and advantages will be better highlighted in an explanatory but not limiting way during the description of a preferred embodiment of the invention with reference to the annexed drawings, wherein.

DESCRIPTION OF THE INVENTION

The locking device of the invention is generally indicated with 1 in the following FIGS. 1 and 2, where is shown with an isometric view and a longitudinal section respectively.

Figure 1:
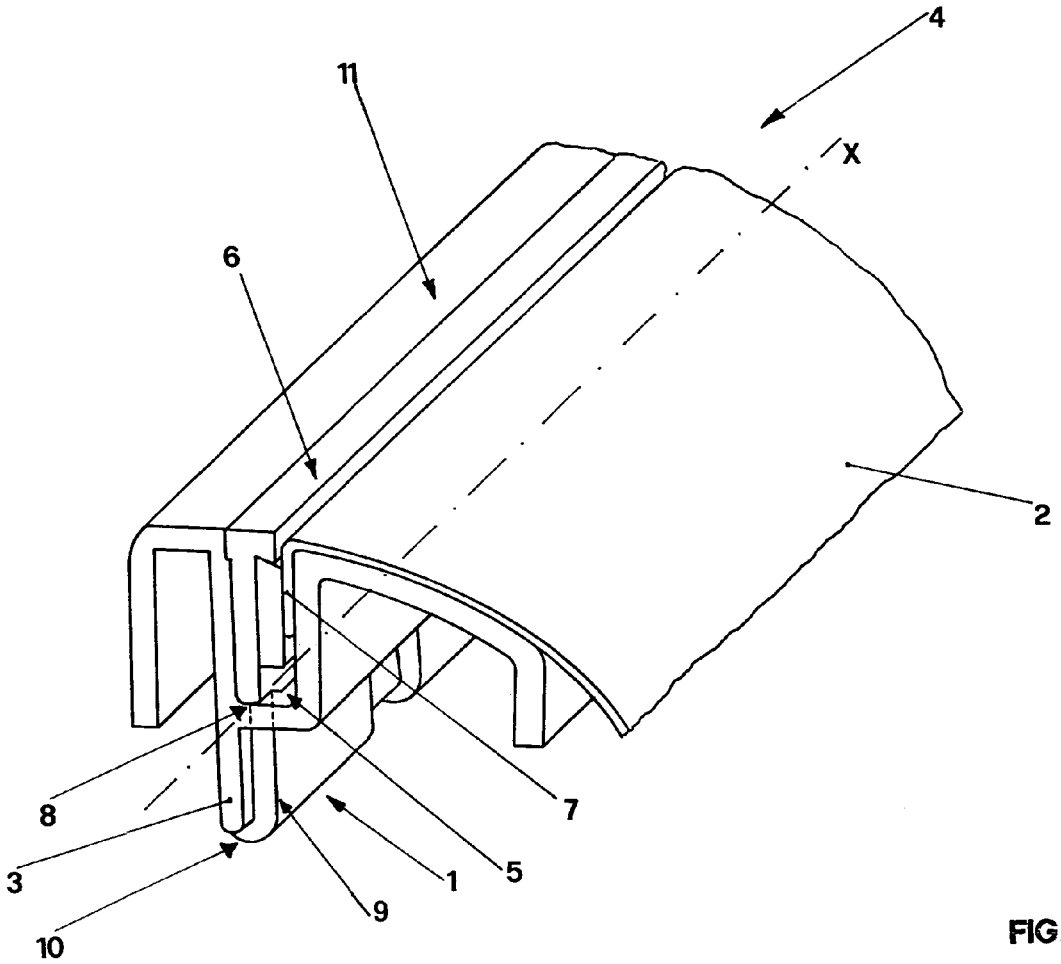
FIG. 1 is an isometric view of the locking device of the invention.

As shown in FIG. 1, the locking device connects a flexible laminar element 2, made of synthetic fibres, to a frame 3 in order to achieve a bearing structure 4, of which only a detail is illustrated, suitable for housing a person's body.

Regarding the frame 3, it is preferably made of a plastic material through an injection moulding operation.

Regarding the flexible laminar element instead, in other embodiments it could consist of a cloth also made of natural or mixed fibres, or it could take up the form of a net or alike made of a plastic material.

According to the invention, the locking device 1 comprises a groove 5 obtained along the perimeter, generally indicated with 11, of the frame 3 and a shaped insert 6 which is pressed into the groove 5 in order to constrain the perimetral edge 7 of the flexible laminar element 2 between the groove 5 and the shaped insert 6.

Furthermore, a plurality of openings, generally indicated with 8, is obtained inside the groove 5, in order to allow the passage of as many corresponding appendixes 9 present on the shaped insert 6 equipped with coupling means, generally indicated with 10, which snap the shaped insert 6 to the frame 3.

Figure 3:
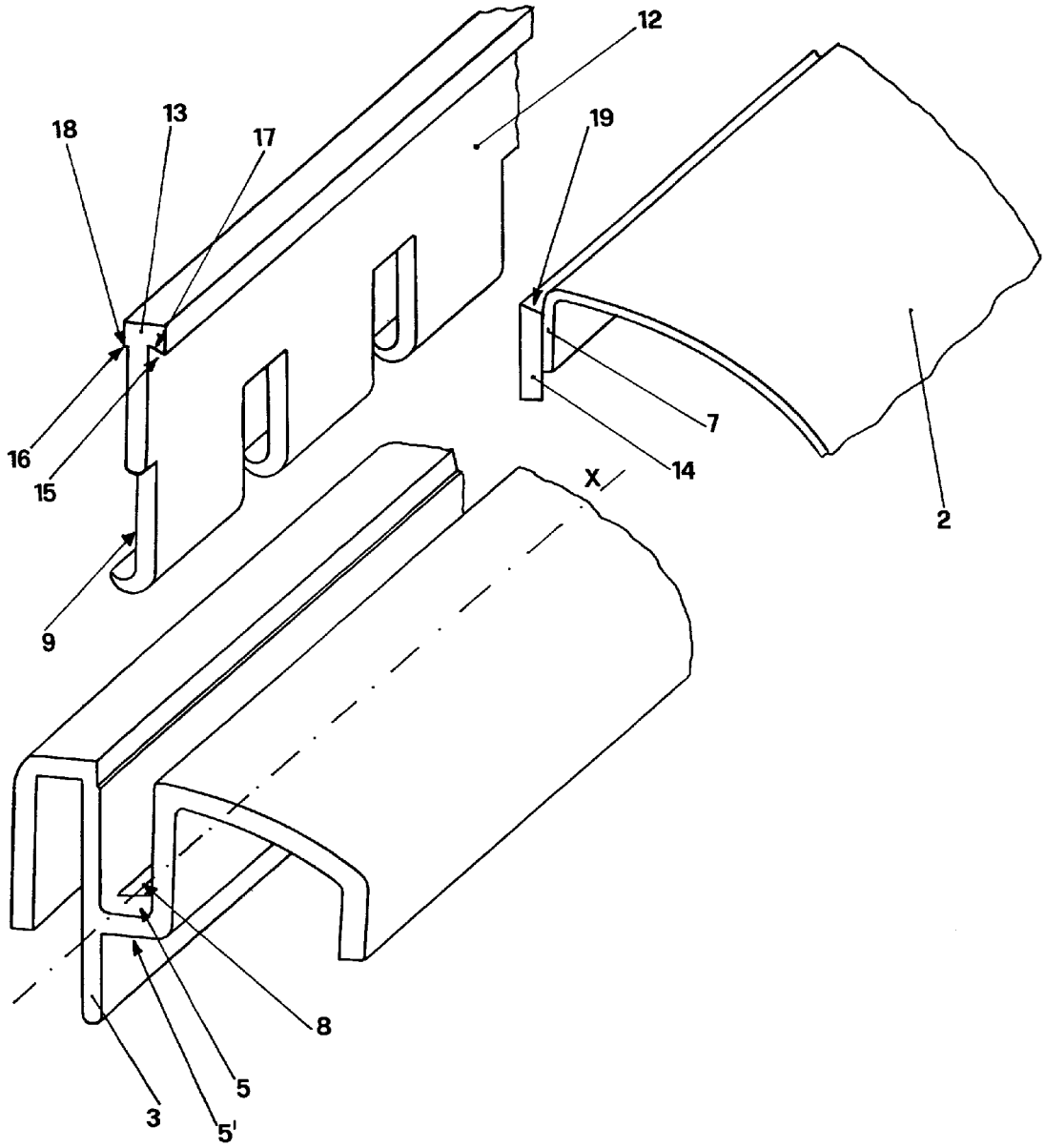
FIG. 3 is an exploded isometric view of the locking device of FIG. 1.

In FIG. 3 it must be noticed that the groove 5 has a profile 5' mainly with a U shape that is developed according to a longitudinal direction X along the frame 3.

Figure 4:
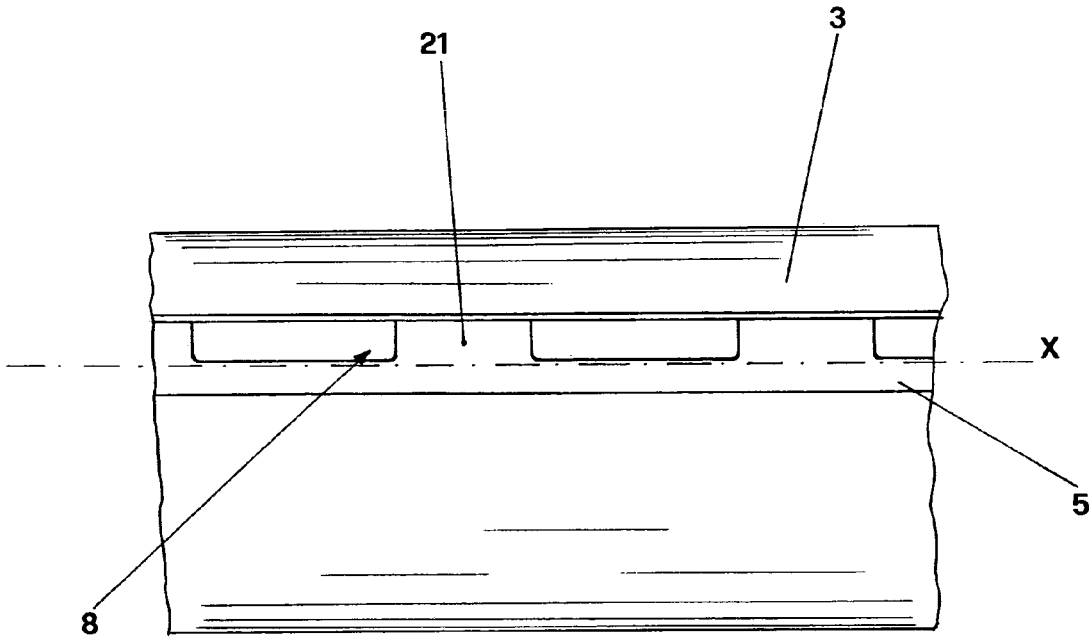
FIG. 4 is a plane view of a detail of FIG. 3.

As better shown in FIG. 4, the openings 8 are obtained at the bottom 21 of the groove 5 along said longitudinal direction X.

Figure 2:
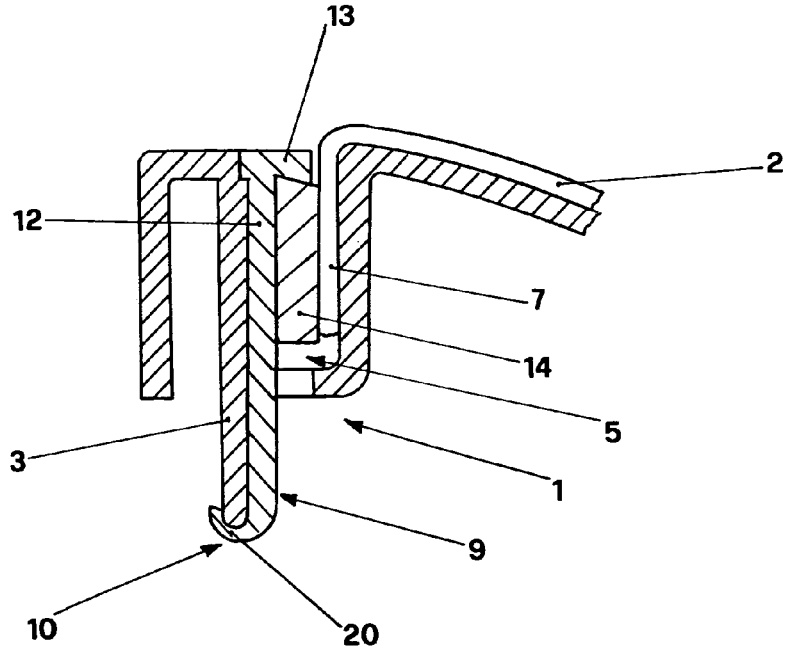
FIG. 2 is a longitudinal section of the locking device of FIG. 1.

According to the preferred embodiment of the invention that is here described and with reference to the FIG. 2, the shaped insert 6 comprises a first laminar body 12, made of a synthetic material, in this case of polyamide, with a mainly longitudinal development and equipped with the appendixes 9 and, at the opposite side, with a shaped head 13.

The shaped insert 6 further comprises a second laminar body 14, made of polyvinyl chloride (PVC), it too with a mainly longitudinal development, which the perimetral edge 7 of the flexible laminar element 2 is applied to, in this case through welding.

In such manner, when the first laminar body 12 and the second laminar body 14 are pressed into the groove 5, they constrain the perimetral edge 7 of the flexible laminar element 2 to the frame 3 by arranging themselves juxtaposed and mutually in contact.

Furthermore, in FIG. 3 one can see that the shaped head 13, which is arranged as cover to the groove 5 when the locking device 1 of the invention is in the operative mode, defines a first shoulder 15 on the first laminar body 12, which receives the second laminar body 14 and the second shoulder 16, opposed to the first shoulder 15, which matches the frame 3 inside of the groove 5.

More specifically, as shown again in FIG. 3, the first shoulder 15 has an opposing surface 17 slanted upwards and converging towards the first laminar body 12, which matches in a stable but removable manner the upper edge 19 of the second laminar body 14, so as to prevent the accidental separation of the latter when it gets applied to the first laminar body 12.

The second shoulder 16, instead, has an opposing surface 18 slanted upwards but divergent from the first laminar body 12, which matches the frame 3.

In FIGS. 1 and 2, is at last emphasized that the coupling means 10, which further secure the shaped insert 6 into the groove 5, consist of the ends 20 of the appendixes 9 folded into a hook shape so as to partially enclose the frame 3.

Operatively, after having applied, through welding, the perimetral edge 7 of the flexible laminar element 2 to the second laminar body 14 made of PVC of the shaped insert 6, the operator juxtaposes the second laminar body 14 to the first laminar body 12, arranging them mainly parallel and so as to couple the perimetral edge 19 of the first one with the opposing surface 18 of the second one.

Having completed this operation, the shaped insert 6 thus obtained is pressed into the groove 5 found on the frame 3.

The appendixes 9 of the first laminar body 12 pass through the corresponding openings 8 present at the bottom 21 of the groove 5.

The application of the locking device 1 to the frame 3 ends with snapping the ends 20 of the appendixes 9 to the same frame 3 and with the positioning of the shaped head 13 of the first laminar body 12 as a cover for the groove 5.

In this situation, the polyamide shaped head 13 protects the second PVC laminar body 14 from sun rays exposure that otherwise, due exactly to the material which is made of, would damage it thus severely jeopardizing its functionality.

Whenever someone wishes to carry out either check up or cleaning operations of the flexible laminar element 2 and of the components of the locking device 1, or replace the same flexible laminar element 2, it would be enough to work on the coupling means 10, by releasing the ends 20 of the appendix 9 of the first laminar body 12 from the frame 3 and by removing the shaped insert 6 from the groove 5.

The user will then be able either to change, according to his/her own needs and preferences, the type and colour of the flexible laminar element, or to replace it when it is particularly deteriorated.

Figure 5:
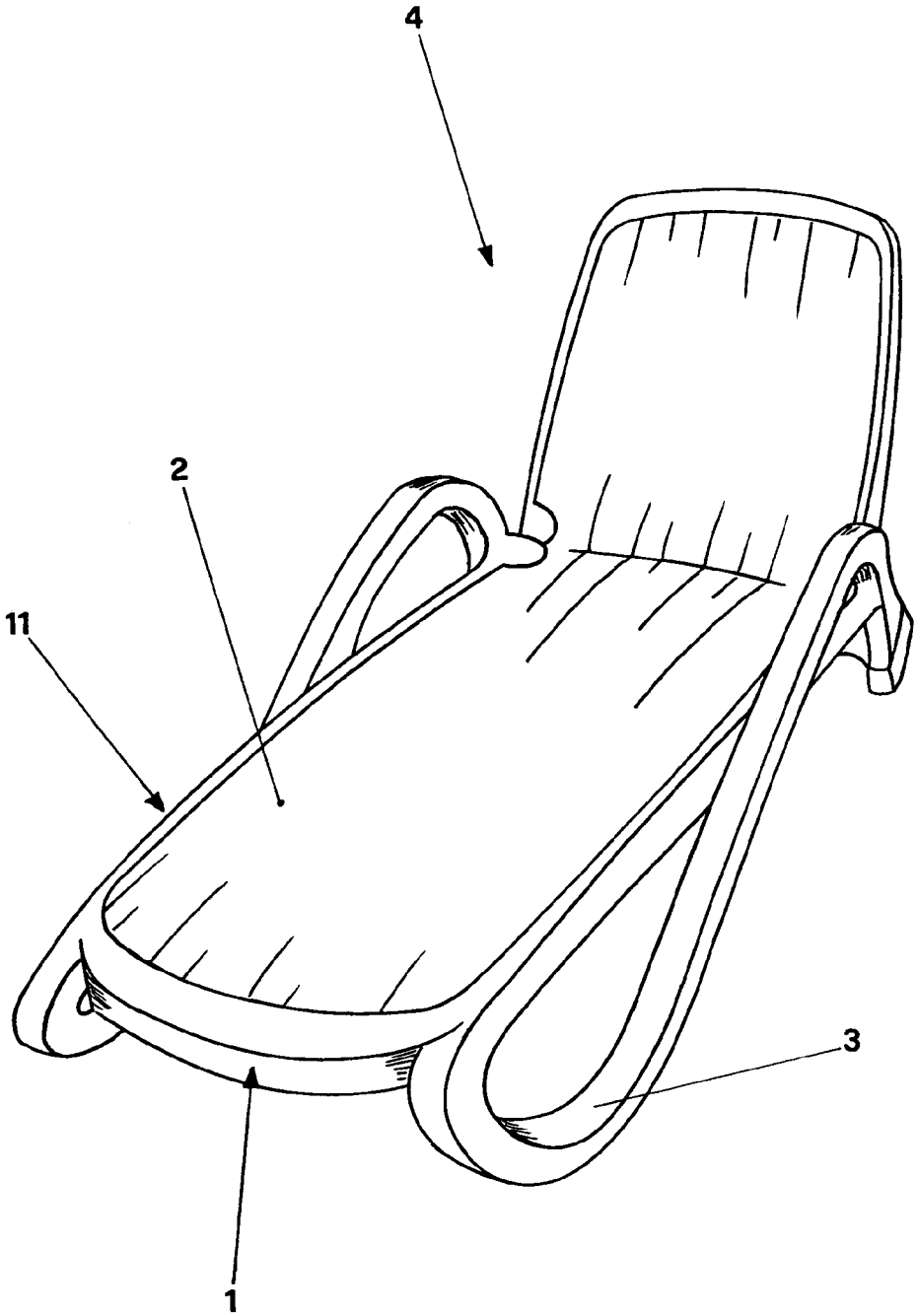
FIG. 5 is an isometric view of an embodiment of the locking device of FIG. 1.

At last in FIG. 5 an embodiment of the locking device 1 of the invention is shown.

The bearing structure 4 obtained is in this case a sun-bed wherein a person can either lay on or lean on it.

According to a further operative embodiment, the flexible laminar element could be applied to the second laminar body of the shaped insert through gluing.

It is thus understood from what has been previously said that the locking device of the invention accomplishes all of the previously mentioned objects and advantages.

In the operative phase variations can be brought to the locking device of the invention.

Hence for example, the grooves could not be obtained along the entire perimeter of the frame of the bearing structure, but instead only along two parallel and opposing stretches of the same frame.

It is understood that all previously mentioned or not mentioned variations, should be all considered protected anyhow by the present patent if falling within the scope of the following claims.

The invention claimed is:

1. A locking device of a flexible laminar element connected to a frame in order to achieve a bearing structure which houses a person's body, comprising:

a groove obtained along at least one part of the perimeter of said frame and a shaped insert suitable for being pressed into said groove in order to constrain the perimetral edge of said flexible laminar element between said groove and said shaped insert; inside said groove a plurality of openings is arranged for the passage of as many appendixes of said shaped insert equipped with coupling means fit to snap said shaped insert to said frame, said shaped insert comprising:

a first laminar body with a mainly longitudinal development and equipped with said appendixes and with a shaped head arranged as a cover for said groove at the opposite side of said appendixes, said shaped head defining a first shoulder on said first laminar body fit to receive a second laminar body, and a second laminar body with a mainly longitudinal development defining a second shoulder, opposed to said first shoulder, suitable for matching said frame inside of said groove, which said perimetral edge of said flexible laminar element is applied to, said first laminar body and said second laminar body being juxtaposed and mutually in contact in order to constrain said perimetral edge of said flexible laminar element to said frame when they are pressed into said groove, wherein said first shoulder has an opposing surface slanted upwards and converging towards said first laminar body, so as to prevent the separation of said second laminar body from said first laminar body.

2. The locking device according to claim 1 wherein said groove has a U shaped profile developed according to a longitudinal direction along said frame.

3. The locking device according to claim 2, wherein said openings are obtained at the bottom of said U shaped groove along said longitudinal direction.

4. The locking device according to claim 1, wherein said second shoulder has an opposing surface slanted upwards and divergent from the first laminar body.

5. The locking device according to claim 4, wherein said second laminar body has an upper edge fit to match in a stable but removable manner said opposing surface of said first shoulder.

6. The locking device according to claim 1, wherein said coupling means consist of the end of said appendixes folded into a hook shape.

7. The locking device according to claim 1, wherein said first laminar body of said shaped insert is made of synthetic material.

8. The locking device according to claim 1, wherein said second laminar body of said shaped insert is made of polyvinyl chloride (PVC).

9. The locking device according to claim 1, wherein said perimetral edge of said flexible laminar element is applied through welding to said second laminar body of said shaped insert.

10. The locking device according to claim 1, wherein said perimetral edge of said flexible laminar element is applied through gluing to said second laminar body of said shaped insert.

11. The locking device according to claim 1, wherein said flexible laminar element is made of cloth.

12. The locking device according to claim 11, wherein said cloth is made of synthetic fibres.

13. The locking device according to claim 11, wherein said cloth is made of natural fibres.

* * * * *